US012697651B2

(12) United States Patent
Adam et al.

(10) Patent No.: US 12,697,651 B2
(45) Date of Patent: Aug. 4, 2026

(54) METHOD TO OPERATE A HYDRAULIC PRESS FOR METAL SHEET FORMING

(71) Applicant: DITEVEN LIMITED, West Sussex (GB)

(72) Inventors: George J.S. Adam, Coventry (GB); Mark W. Brazier, Coventry (GB); Alistair D. Foster, Coventry (GB)

(73) Assignee: DITEVEN LIMITED:, West Sussex (GB)

( * ) Notice: Subject to any disclaimer, the term of this patent is extended or adjusted under 35 U.S.C. 154(b) by 0 days.

(21) Appl. No.: 18/748,585

(22) Filed: Jun. 20, 2024

(65) Prior Publication Data

US 2025/0018454 A1 Jan. 16, 2025

Related U.S. Application Data

(63) Continuation of application No. 15/326,175, filed as application No. PCT/GB2015/052018 on Jul. 13, 2015, now abandoned.

(30) Foreign Application Priority Data

Jul. 14, 2014 (GB) ..... 1412486.1

(51) Int. Cl.
*B21D 22/20* (2006.01)
*B21D 35/00* (2006.01)
(Continued)

(52) U.S. Cl.
CPC ..... *B21D 22/208* (2013.01); *B21D 35/005* (2013.01); *C21D 1/673* (2013.01); *C22F 1/04* (2013.01); *C22F 1/06* (2013.01)

(58) Field of Classification Search
CPC .... B21D 22/208; B21D 35/005; C21D 1/673; C22F 1/04; C22F 1/06
See application file for complete search history.

(56) References Cited

U.S. PATENT DOCUMENTS 3,756,145 A 9/1973 Amacker
3,827,328 A 8/1974 LaFlamme et al.
(Continued)

FOREIGN PATENT DOCUMENTS

CN 102216484 A 10/2011
CN 102712985 A 10/2012
(Continued)

OTHER PUBLICATIONS

International Search Report and Written Opinion of the International Searching Authority, Application No. PCT/GB2015/052018, mailed Oct. 20, 2015, 7 pages.
(Continued)

*Primary Examiner* — Adil A. Siddiqui
(74) *Attorney, Agent, or Firm* — Meunier Carlin & Curfman LLC

(57) ABSTRACT

The invention is a process for forming a metal alloy component comprising: heating a metal alloy sheet blank to at least its Solution Heat Treatment temperature at a heating station; transferring the heated sheet blank to a press; initiating formation of a component by closing the press dies at a first speed then completing the formation by closing the press dies at a second speed, said second speed being slower than the first; and holding the formed component in the dies during cooling of the formed component.

13 Claims, 2 Drawing Sheets

(51) Int. Cl.

| | |
|---|---|
| ***C21D 1/673*** | (2006.01) |
| ***C22F 1/04*** | (2006.01) |
| ***C22F 1/06*** | (2006.01) |

(56) References Cited

U.S. PATENT DOCUMENTS

| | | | | |
|---|---|---|---|---|
| 3,841,140 | A | 10/1974 | Hrye | |
| 3,953,187 | A | 4/1976 | James | |
| 4,148,203 | A | 4/1979 | Farazandeh et al. | |
| 4,242,901 | A | 1/1981 | Pearson et al. | |
| 4,297,870 | A | 11/1981 | Pearson et al. | |
| 4,797,831 | A | 1/1989 | Dressing et al. | |
| 5,069,060 | A | 12/1991 | Ishii | |
| 6,003,429 | A * | 12/1999 | Nakabayashi | B30B 1/323 91/509 |
| 2003/0084794 | A1 * | 5/2003 | Koyama | F15B 11/022 100/269.01 |
| 2010/0187291 | A1 | 7/2010 | Kriegner et al. | |
| 2012/0073347 | A1 | 3/2012 | Luckey et al. | |
| 2012/0152416 | A1 * | 6/2012 | Foster | C22F 1/10 148/695 |
| 2013/0125606 | A1 | 5/2013 | Lin et al. | |
| 2014/0202345 | A1 | 7/2014 | Wood | |
| 2014/0338802 | A1 | 11/2014 | Okita et al. | |

FOREIGN PATENT DOCUMENTS

| | | | |
|---|---|---|---|
| EP | 2324137 | B1 | 1/2013 |
| EP | 15738457.9 | B1 | 5/2017 |
| WO | 2008059242 | A2 | 5/2008 |
| WO | 2008101567 | A1 | 8/2008 |
| WO | 2010032002 | A1 | 3/2010 |
| WO | 2011058332 | A1 | 5/2011 |
| WO | 2016009185 | A1 | 1/2016 |

OTHER PUBLICATIONS

Jeon, J. Y., Matsumoto, R., & Utsunomiya, H. (2014). Two-Step Die Motion for Die Quenching of AA2024 Aluminum Alloy Billet on Servo Press. Materials Transactions, 55(5), 818-826.

International Preliminary Report on Patentability, issued by the International Bureau of WIPO, Application No. PCT/GB2015/052018, dated Jan. 17, 2017, 6 pages.

First Office Action, issued by the State Intellectual Property Office of the People's Republic of China, Application No. 201580037966.5, dated Jan. 24, 2018, 16 pages.

Search Report, issued by the State Intellectual Property Office of the People's Republic of China, Application No. 2015800379665, dated Jan. 15, 2018, 2 pages.

Communication pursuant to Rule 114(2) EPC enclosing Observations by a Third Party Regarding Patentability, issued by the European Patent Office in connection with European Application No. 15738457.9, dated Jul. 16, 2018, 36 pages.

Kirk, A. and Neil, J.: Selecting a hydraulic hot-stamping press; Frame style, guiding, tonnage, ram closing speed are key, Stamping Journal, Jul./Aug. 2014, Jun. 27, 2014 (including printout from www.archive.org).

Hayashi, H. and Nishimura, H.: The Application of Servo Press Machine to Forming of Sheet Metals With Low Formability, the Annals of "Dunarea De Jos" University of Galati, Fascicle V, Technologies in Machine Building, ISSN 1221-4566, 2009.

Yanagimoto, J. et al: Controlled Semisolid Forging of Aluminium Alloys Using Mechanical Servo Press to Manufacture Products with Homo-and Heterogeneous Microstructures, Materials Transactions, vol. 54, No. 7 (2013) pp. 1149-1154.

Karbasian, H. and Tekkaya, A.E.: A review on hot stamping, Journal of Materials Processing Technology 210 (2010) 2103-2118.

Kaya, S.; Altan, T.: "Non-isothermal deep drawing of aluminum and magnesium using servo presses", In: Proceedings of International Manufacturing Science and Engineering Conference (MSEC), 2010.

Azpilgain, Z., et al: Servomechanical Press: A New Press Concept for Semisolid Forging, Solid State Phenomena vols. 141-143 (2008), pp. 261-266.

Excerpt from presentation by Dr. Eren Billur and Prof. Taylan Altan from Ohio State University on Oct. 15, 2013.

Alta, T. and Tekkaya, A.E. (editors): Sheet Metal Forming, Processes and Applications, ASM International, Materials Park, OH, 2012, Ch. 5, pp. 83-106.

Alta, T. and Tekkaya, A.E. (editors): Sheet Metal Forming, Processes and Applications, ASM International, Materials Park, OH, 2012, Ch. 7, pp. 133-156.

Alta, T. and Tekkaya, A.E. (editors): Sheet Metal Forming, Fundamentals, SM International, Materials Park, OH, 2012, Ch. 11-12, pp. 15, 161-201.

Second Office Action issued by the National Intellectual Property Administration of the People's Republic of China in connection with Chinese Application No. 201580037966.5, dated Oct. 8, 2018.

Preliminary Examination Report issued in connection with corresponding Brazilian Application No. BR 11 2017 000753 3, dated Aug. 21, 2019.

Decision of Rejection issued in connection with corresponding Chinese Application No. 201580037966.5, dated Oct. 9, 2019.

Taylan Altan, et al., Sheet Metal Forming—Fundamentals, pp. 190-193, ASM International, The Material Information Society, Aug. 31, 2012.

Office Action and Supplementary Search Report issued in connection with corresponding Chinese Patent Application CN201580037966.5, dated May 8, 2020.

Fifth Office Action issued by the China National Intellectual Property Administration in corresponding Chinese Application No. 201580037966.5, dated Sep. 21, 2020.

Examination Report issued in connection with corresponding Mexican Patent Application No. MX/a/2017/000453, dated Aug. 3, 2021.

International Preliminary Report on Patentability issued on Jan. 17, 2017, in PCT/GB2015/052018.

Examination Report issued by the European Patent Office in connection with European Patent Application No. 15738457.9, dated Feb. 9, 2018.

Examination Report issued by the European Patent Office in connection with European Patent Application No. 15738457.9, dated Sep. 13, 2018.

Examination Report issued by the European Patent Office in connection with European Patent Application No. 15738457.9, dated May 28, 2019.

Examination Report issued by the European Patent Office in connection with European Patent Application No. 15738457.9, dated Jan. 21, 2020.

Communication under Rule 71(3) EPC, Intention to Grant, issued in corresponding European Application No. 15738457.9, dated Jul. 13, 2020.

International Search Report and Written Opinion, issued by the International Searching Authority (European Patent Office) in connection with the International Application No. PCT/GB2015/052018, mailed Oct. 20, 2015.

Communication pursuant to Rule 114(2) EPC dated May 15, 2019, from related EP application No. 15738457.9, 28 pages.

Communication pursuant to Article 94(3) dated May 28, 2019, from related EP Application No. 15738457.9, 3 pages.

Third Office Action issued by the China National Intellectual Property Administration dated Apr. 28, 2019, from related CN Application No. 201580037966.5, 19 pages.

Stefanescu, Doru M., Ruxanda, Roxanda, "Solidification Structures of Aluminum Alloys," Jul. 21, 2004, The University of Alabama, pp. 1-2, Fig. 2 (Year: 2004).

Stamtec, Servo Presses, Jun. 27, 2013, https://web.archive.org/web/20130627081643/http://www.stamtec.com:80/catalog/presses/servo-presses (Year: 2013).

Mori, Ken-ichiro, "Application of Servo Presses to Sheet Metal Forming," 2011, Trans Tech Publications Ltd, Key Engineering Materials vol. 473, pp. 27-36 (Year: 2011).

* cited by examiner

METHOD TO OPERATE A HYDRAULIC PRESS FOR METAL SHEET FORMING

The present invention relates to an improved method of forming metal alloy sheet components and more particularly Al-alloy sheet components. The method is particularly suitable for the formation of formed components having a complex shape which cannot be formed easily using known techniques.

To improve the environmental performance of automotive vehicles, vehicle OEMs are moving towards lightweight alloys for formed components. Traditionally, there was considerable trade-off between the strength of the alloy used and the formability of the alloy. However, new forming techniques such as HFQ® have allowed more complex parts to be formed from high-strength lightweight alloy grades such as 2xxx, 5xxx, 6xxx and 7xxx series aluminium alloys.

Age hardening Al-alloy sheet components are normally cold formed either in the T4 condition (solution heat treated and quenched), followed by artificial ageing for higher strength, or in the T6 condition (solution heat treated, quenched and artificially aged). Either condition introduces a number of intrinsic problems, such as spring-back and low formability which are difficult to solve. Hot stamping can increase formability and reduce spring-back, but it destroys the desirable microstructure. Post-forming Solution Heat Treatment (SHT) is thus required to restore the microstructure, but this results in distortion of the formed components during quenching after SHT. These disadvantages are also encountered in forming engineering components using other materials.

In an effort to overcome these disadvantages, various efforts have been undertaken and special processes have been invented to overcome particular problems in forming particular types of components.

One such technique utilises Solution Heat Treatment, forming, and cold-die quenching (HFQ®) as described by the present inventors in their earlier application WO2008/059242. In this process an Al-alloy blank is solution heat treated and rapidly transferred to a set of cold dies which are immediately closed to form a shaped component. The formed component is held in the cold dies during cooling of the formed component.

A further development to the HFQ® technique, as described by the present inventors in EP2324137, involves extremely rapid die closure. This allowed for high quality parts to be produced. However, this high speed of closure of the dies is not attainable with conventional presses and requires either specialised tooling to be produced or significant upgrades made, which increases the set up cost substantially.

In the process described in EP2324137, the hot pressing may require a press stroke speed of above 100 mm/s, and to achieve parts with optimum properties, a press speed of 400 mm/s or greater may be required. More conventional presses operate at a much slower speed, for example, they typically have a maximum powered stroke speed of less than 50 mm/s.

It is an aim of the present invention to provide a process for forming an aluminium alloy component which mitigates or ameliorates at least one of the problems of the prior art, or provides a useful alternative.

According to a first aspect of the invention, there is provided a process for forming a metal alloy component comprising:

heating a metal alloy sheet blank to at least its Solution Heat Treatment temperature at a heating station;

transferring the heated sheet blank to a press;

initiating formation of a component by closing the press dies at a first speed then completing the formation by closing the press dies at a second speed, said second speed being slower than the first; and holding the formed component in the dies during cooling of the formed component.

As would be understood by the skilled person, the Solution Heat Treatment (SHT) temperature is the temperature at which Solution Heat Treatment is carried out. The SHT temperature range varies depending on the alloy being treated. Typically, this requires heating the alloy to at least its solvus temperature, but below the solidus temperature.

Initiating formation of a component by closing the press dies at a first speed may comprise using a non-powered stroke of the press, or it may comprise a low-powered, high speed stroke of the press. For example, a fast approach mode of the press may be used. The non-powered stroke may comprise allowing the press to close under the force of gravity. The first speed may be at least 100 mm/s. The non-powered stroke may be partially limited or restricted, for example, to control the closing speed. In one embodiment, the first speed is controlled by limiting or restricting the flow of hydraulic fluid into the press.

Completing the formation by closing the press dies at a second speed may comprise using a powered stroke of the press. For example, the powered stroke may comprise a hydraulically or pneumatically powered stroke. The second speed may be less than 100 mm/s. In one embodiment, the second speed is less than 50 mm/s. The second speed may be the maximum powered speed of the press.

The process is capable of being carried out without the need for significant press modifications. The press may be of the hydraulic press type and/or may have a fast approach speed of at least 100 mm/s. The fast approach mode is typically used to lower the tool through the daylight prior to forming. In the described invention, this mode may also be used to press the sheet blank for the majority of the forming stroke. For example, the first speed may comprise the fast approach speed. The hydraulic system may then be then fully or partially engaged to finalise the formation of the component and to subsequently hold the formed component under load until quenched. It may be beneficial to engage the powered stroke at the lowest practicable ram position, for example, 10 mm above absolute bottom, 2 mm above absolute bottom or, if sufficient precision is possible on the forming press and for some embodiments, 0.5 mm above absolute bottom. It is intended that 'absolute bottom' refers to the position at which the dies are fully closed around the sheet blank.

In hot forming methods such as HFQ®, the inventors have found that the sheet blank can be shaped with relatively little resistance over the majority of the forming stroke. As such, the forming force required is very low compared to standard cold pressing. In fact, it has been found that the forming force for the initial deep drawing of a component may be negligible when compared to the press capabilities. This allows the first part of forming to be completed using the free-fall energy of the press ram e.g. during the fast approach mode of the press.

The forming speed is critical to the deep-draw potential of processes such as HFQ®, as the blank draw-in is highly rate-dependent at hot forming temperatures and a fast forming speed both increases the material draw-in and aids the stability of the forming process. However, in the final stages of forming, the majority of the deep drawing has been completed and the remaining forming stroke is predominantly concerned with forming the component details such as tight bend radii and imparting the correct contours to the sheet. Previous logic had been that fast forming was required throughout the entire stroke, as it was known that a faster overall speed resulted in better draw-in of material and a better overall material thickness distribution.

The process may comprise, in the case of metal alloys not in a pre-age-hardened temper, maintaining the Solution Heat Treatment temperature until Solution Heat Treatment is complete. The Solution Heat Treatment is complete when the desired amount of the alloying element or elements responsible for precipitation or solution hardening have entered solution. For example, The Solution Heat Treatment may be complete when at least 50% of the alloying element or elements have entered solution. Alternatively, the SHT may be complete when at least 60, 70, 75, 80, 90, 95 or substantially 100% of the alloying element or elements have entered solution.

Heating the metal alloy sheet blank to its Solution Heat Treatment temperature may comprise heating the sheet blank to at least its solvus temperature. The process may comprise heating the blank to above its solvus temperature but below its solute temperature. In one embodiment, the blank is heated to between 470° C. and 580° C.

The metal alloy may comprise an aluminium alloy. For example, the alloy may comprise an aluminium from the 6xxx or 7xxx alloy families. Alternatively, the alloy may comprise a magnesium alloy.

The heated sheet blank may be transferred to the press within 10 seconds of being removed from the heating station. In one embodiment, the forming is initiated within 10 seconds of removal from the heating stating so that heat loss from the sheet blank is minimised. The press may comprise a set of unheated or cold dies. Additionally or alternatively, the dies may be cooled.

In one series of embodiments, the first speed is at least 100 mm/s. Initiating forming of a component may comprise forming the blank at a temperature above 350° C. Initiating formation of a component may comprise closing the press dies to a first position. The first position may comprise closing the dies to within at least 30 mm of the die absolute bottom position. Alternatively, the first position may be within 25, 20, 15, 10, 8, 6, 5, 4, 3, 2, 1, or 0.5 mm from the absolute bottom position. Completing the formation may comprise closing the press dies through the remaining distance from the first position to the absolute bottom position. Completing the formation may comprise closing the dies through a smaller distance than initiating the formation.

The process may comprise a pause between the closing of the dies at a first speed and the closing of the dies at a second speed. The pause may be less than 5 seconds, or it may be less than 4, 3, 2, 1, 0.75, 0.5 or 0.25 seconds.

Holding the formed component in the dies during cooling of the formed component May comprise holding the formed component until quenched. For example, the blank may be quenched to below 200° C.

Closing the dies at a first speed may be performed to within 0.5 mm or less of the die absolute bottom position.

Most hydraulic presses have a 'fast down' feature, which is used to rapidly descend the top tool towards the loaded blank. The designed purpose of this feature is to quickly traverse the open space between the tool and the blank that is necessary for loading the sheet blank and unloading the pressed component.

When used in the 'fast down' mode, the energy available to displace the ram and top tool is mainly due to the gravitational potential of the combined mass of the ram and the tool. The speed of descent may be controlled or limited by restricting the flow rate of hydraulic fluid into the ram's cylinder(s). It may be possible to increase the maximum fast down speed of the press by increasing the maximum return rate of hydraulic oil into the cylinder(s), e.g. by increasing the diameter of the relevant pipework and valves. This is a relatively inexpensive modification.

The pressing force available under the fast descent mode is minimal and thus it is not known to be used as a means to impart shape on the blank. Instead, the power stroke mode is engaged in which hydraulic fluid is pumped into the ram cylinder(s) to provide the forming force. The speed of this stroke is often less than 50 mm/s which is too slow to successfully form all but the simplest, shallow drawn components using a hot forming process such as HFQ®.

By using the fast descent mode to part-form the component, followed by the slower, powered mode to complete the forming, the following advantages are achieved in hot forming:

- increased component complexity and draw depth on a conventional hydraulic press; and
- reduced dynamic impact when the tools close (compared to a powered fast stroke).

Embodiments of the present invention will now be described by way of example and with reference to the accompanying Figures, in which.

Figure 1:
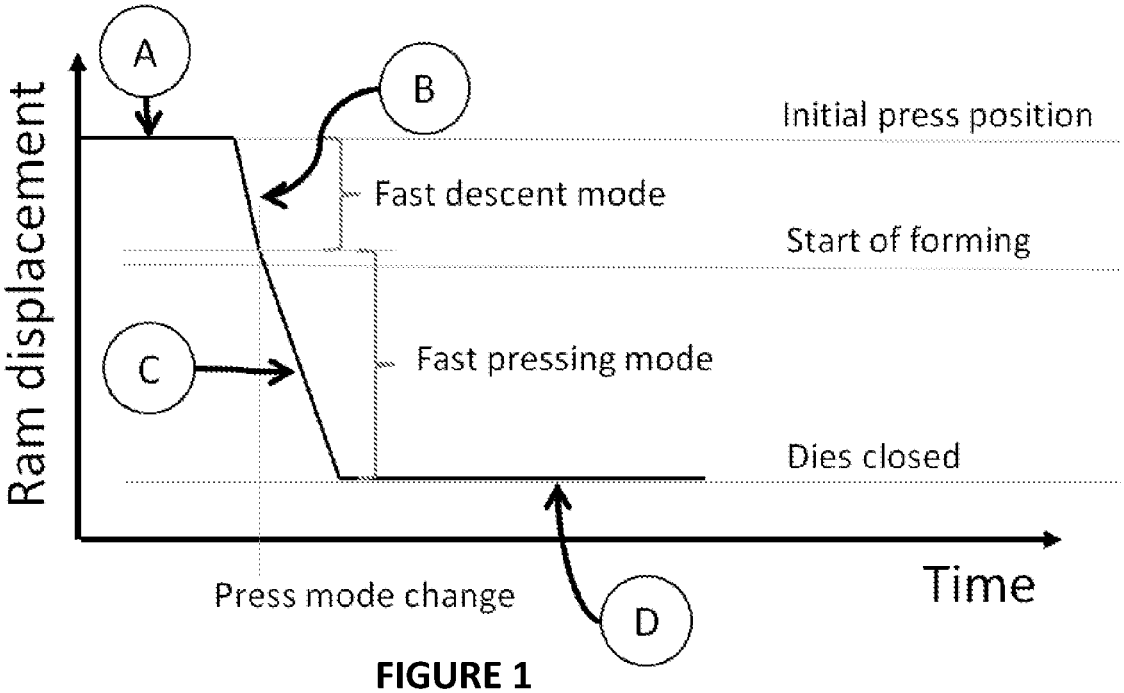
FIG. 1 is a diagram showing an operation profile according to conventional HFQ® processes.

Turning now to FIG. 1, there is shown a graph of ram displacement against time for a hydraulic press operating a conventional HFQ® process.

During stage A, the hydraulic press is fully open with the dies separated to enable the loading and unloading of the metal sheet blank into the press. Once the blank is loaded, the forming process is initiated. During step B, the dies are closed using the fast descent feature of the hydraulic ram in order to minimise the amount of time the sheet blank spends out of the heating station prior to being pressed. During the fast descent mode B, the dies are quickly closed until they are or are almost in contact with the metal sheet blank. Typically in a fast descent mode the die falls under the action of gravity, rather than being driven by a hydraulic, pneumatic or similar system.

Once the fast descent is completed and the dies are in contact with or are adjacent to the sheet blank, the hydraulics are engaged and the press operated in a fast pressing mode. In this example, the fast pressing mode is carried out at approximately the same speed as the fast descent mode and is maintained until the dies are fully closed and the component is formed. Ideally, the fast pressing mode is engaged prior to the start of forming of the component in order to give a smooth and continuous pressure on the sheet blank.

At this point, the dies are kept closed D and the component is quenched between the either cold or cooled dies. Once the quenching step is completed the dies may be opened and the component removed for further processing as required.

Figure 2:
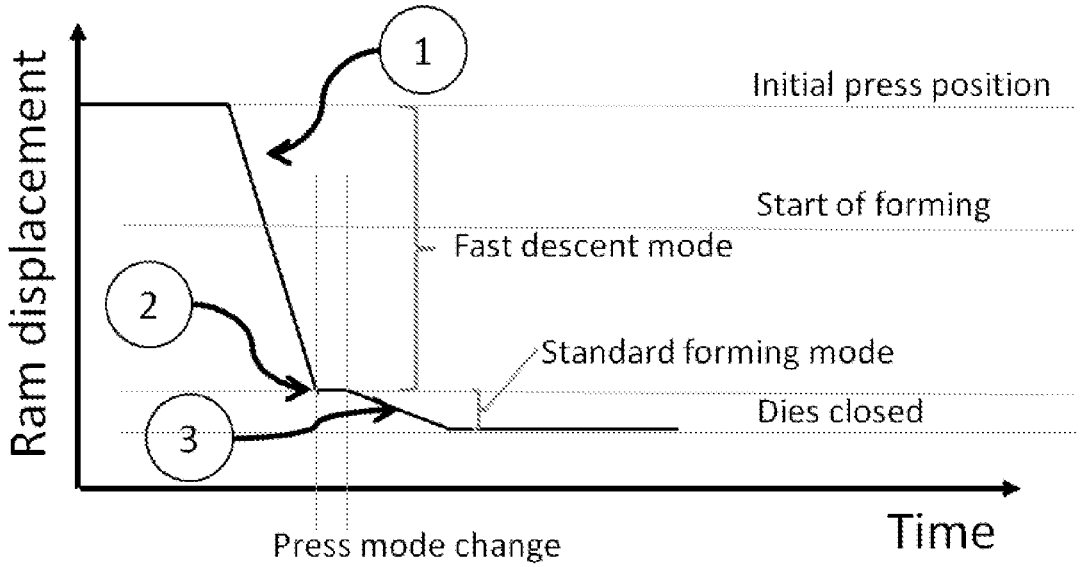
FIG. 2 is a diagram according to the present invention showing the new operation profile.

Turning now to FIG. 2, there is shown the modified profile of the present invention. The initial stage is the same as the prior art, with the dies fully open for loading of a metal sheet blank. A pre-solution heat treated blank is loaded and the fast descent mode is engaged. However, counter to the prior art, the fast descent mode is not disengaged once the dies are in contact or adjacent the sheet blank. Instead, the fast descent mode is continued and used for the initial stage of forming the component. Due to the low resistance and improved malleability of the solution heat treated sheet metal blank, the low power of the fast descent mode is sufficient to initiate forming and carry out the majority of the forming step.

Once a pre-determined level is reached, the fast descent mode is ended 2 and the hydraulics are engaged to operate the press in the standard forming mode 3. During the standard forming mode 3 the fine details and sharp edges of the formed component can be created with a high level of quality. The final stage is the same as in the prior art, with the component being held between the closed dies until quenched. Once quenched, the dies can be opened and the component can be removed and processed further e.g. by ageing. Often there is a pause between the first and second modes due to any delay in the activation of the powered stroke, although this is not vital to the function of the invention.

This modification to the forming process can be carried out using presses that do not have a fast pressing mode, and as such, the process may be carried out using existing equipment without need for expensive re-fitting or entirely new systems. Even though part of the process is carried out at a slow forming speed, it is possible to form complex components to a high standard only thought possible using high speed presses.

Figure 3:
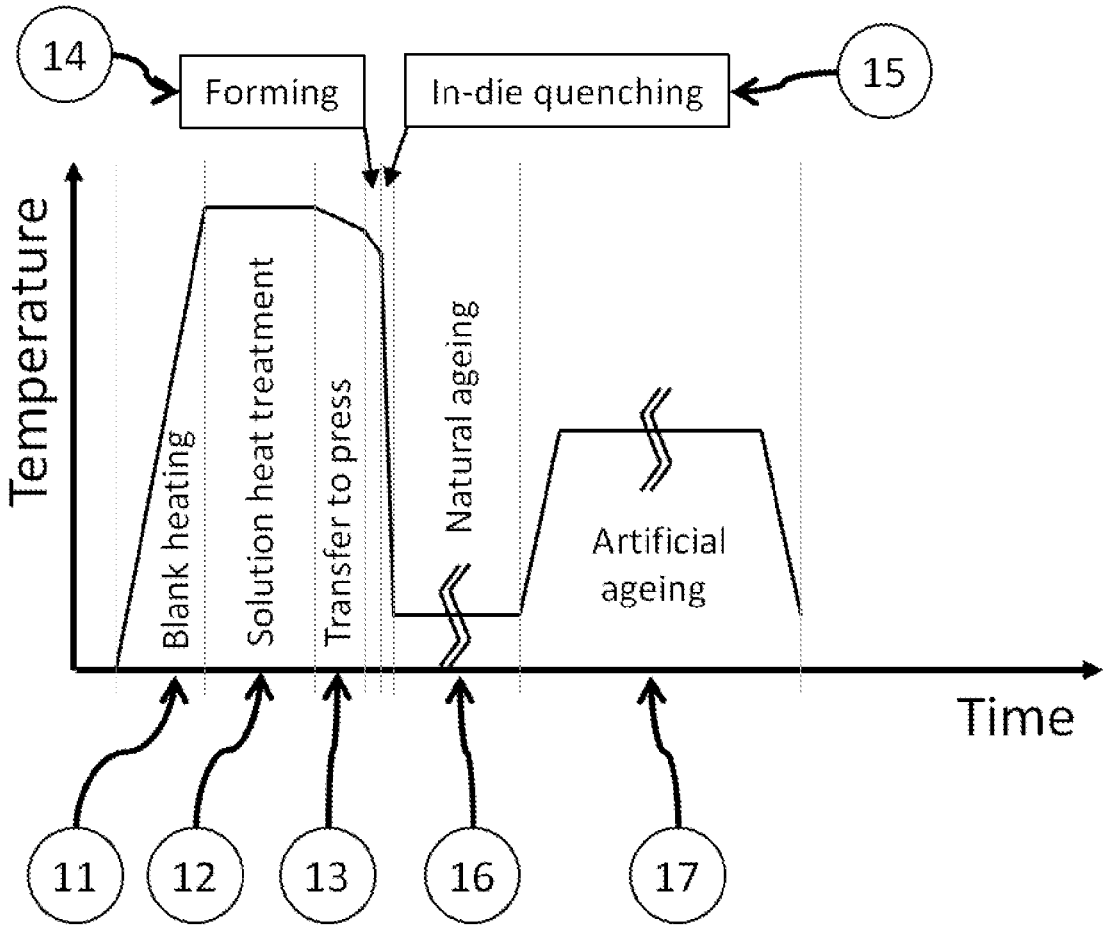
FIG. 3 is a graph showing the temperature profile of a metal component throughout the forming process.

Turning now to FIG. 3, the process is outlined schematically. The blank is first heated to its SHT temperature 11 (e.g. 525° C. for AA6082) and the material is then held at this temperature for the required time period (e.g. 30 minutes for AA6082) if full SHT is required 12. The SHTed sheet blank is then immediately transferred to the press and placed on the lower die 13. This transfer should be quick enough to ensure minimal heat loss from the aluminium blank to the surrounding environment (e.g. less than 5 seconds).

The forming stage 14 then occurs as described above and with reference to FIG. 2. The formation of a component is initiated by closing the press dies at a first speed of at least 100 mm/s. The first speed is maintained until the majority of the forming is completed, by closing the dies to at a first position within approximately 10 mm of the absolute bottom position of the press. The formation is completed by closing the press dies at a second speed, through the remaining distance to the absolute bottom position at a speed of approximately 50 mm/s. There is a brief pause of less than a second between initiating the formation and completing the formation due to the need to engage the mechanism powering the ram. The press is then maintained in the closed position and the formed component is quenched 15 between the dies until the component has cooled to below 200° C.

Once sufficiently cooled, the component may be removed and undergo natural ageing 16. Artificial ageing 17 is then carried out to increase the strength of the finished component (i.e. 9 hours at 190° C. for AA6082). The ageing can be combined with a baking process if the subsequent painting of the formed product is required.

The invention claimed is:

1. A process for pressing a sheet metal component of aluminum or magnesium alloy comprising the sequential steps:

i) heating a metal aluminum or magnesium alloy sheet blank to above its solvus temperature but below its solidus temperature at a heating station;

ii) transferring the heated sheet blank to a press;

iii) initiating formation of a component at an initial temperature above 350° C. by closing the press dies at a first speed to a first position within 30 mm of its absolute bottom position to complete part of the formation, then completing the formation by closing the press dies at a second speed through the remaining distance to the absolute bottom position, said second speed being slower than the first; and iv) quenching the formed sheet alloy component by holding the formed component in the dies during quenching of the formed component.

2. The process of claim 1, wherein closing the press dies at a first speed comprises using a non-powered or low-powered, high speed stroke of the press.

3. The process of claim 2, wherein the first speed comprises a fast approach mode of the press and wherein the first speed is at least 100 mm/s.

4. The process of claim 3, wherein closing the press dies at a second speed comprises using a powered stroke of the press.

5. The process of claim 4, wherein the second speed is less than 100 mm/s.

6. The process of claim 5, wherein the second speed is the maximum powered speed of the press.

7. The process of claim 6, wherein the powered stroke is engaged at the first position.

8. The process of claim 1, wherein the heated sheet blank is transferred to the press within 10 seconds of being removed from the heating station.

9. The process of claim 8, wherein the closing of the press dies at the first speed is performed such that formation of the formed sheet alloy component is initiated within 10 seconds of removal from the heating station.

10. The process of claim 1, wherein the closing of the press dies at the first speed such that formation of the formed sheet alloy component is initiated, comprises closing the press dies to a first position within at least 10 mm of the die absolute bottom position.

11. The process of claim 10, wherein the closing of the press dies at the second speed to complete formation of the formed sheet alloy component, comprises closing the press dies through the remaining distance from the first position to the absolute bottom position.

12. The process of claim 11, wherein the process comprises a pause between the closing of the dies at the first speed and the closing of the dies at the second speed.

13. The process of claim 12, wherein the pause is less than 5 seconds.

* * * * *